US007564420B2

(12) United States Patent
Jeon et al.

(10) Patent No.: US 7,564,420 B2
(45) Date of Patent: Jul. 21, 2009

(54) HYBRID ANTENNA SYSTEM

(75) Inventors: Soon-Ik Jeon, Daejon (KR); Soon-Young Eom, Daejon (KR); Young-Bae Jung, Daejon (KR); Seong-Ho Son, Daejon (KR); Jae-Seung Yun, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 458 days.

(21) Appl. No.: 11/296,542

(22) Filed: Dec. 6, 2005

(65) Prior Publication Data

US 2006/0132371 A1 Jun. 22, 2006

(30) Foreign Application Priority Data

Dec. 7, 2004 (KR) ..... 10-2004-0102360
May 20, 2005 (KR) ..... 10-2005-0042713

(51) Int. Cl.
*H01Q 3/00* (2006.01)

(52) U.S. Cl. ..... 343/757; 343/763; 343/781 P; 343/781 CA

(58) Field of Classification Search ..... 343/781 R, 343/781 P, 781 CA, 779, 757, 761, 763, 766, 343/880, 882
See application file for complete search history.

(56) References Cited

U.S. PATENT DOCUMENTS 4,185,287 A * 1/1980 Hubing et al. ..... 343/761
5,347,286 A * 9/1994 Babitch ..... 342/359
5,351,060 A * 9/1994 Bayne ..... 343/766
6,323,822 B2 * 11/2001 Cook et al. ..... 343/840
2002/0140617 A1 * 10/2002 Luly et al. ..... 343/781 CA

FOREIGN PATENT DOCUMENTS

| | | |
|---|---|---|
| JP | 06-013810 | 1/1994 |
| JP | 06-077719 | 3/1994 |
| JP | 09-311174 | 12/1997 |
| KR | 1996-27397 | 7/1996 |
| KR | 1998-043232 | 9/1998 |
| KR | 2000-0060658 | 10/2000 |

* cited by examiner

*Primary Examiner*—HoangAnh T Le
(74) *Attorney, Agent, or Firm*—Blakely, Sokoloff, Taylor & Zafman LLP

(57) ABSTRACT

A hybrid antenna system for providing a communication service or/and a satellite broadcasting receiving service by coarsely tracking a target satellite in a mechanical fashion and finely tracking the target satellite in an electrical fashion is disclosed. The hybrid antenna system includes: a rotatory unit for tracking a satellite direction using a mechanical movement including a rotating motion and an electron beam tracking function and transmitting/receiving a multi-band frequency from a satellite through a free space; a stationary unit for communicating to an external terminal and/or transmitting and receiving a broadcasting signal from/to the external terminal; and a stabilizing unit for connecting the rotatory unit to the stationary unit, and driving and controlling the rotatory unit in mechanical fashion and electrical fashion.

45 Claims, 13 Drawing Sheets

HYBRID ANTENNA SYSTEM

FIELD OF THE INVENTION

The present invention relates to a hybrid antenna system; and, more particularly, to a multi-band hybrid antenna system mountable on a mobile unit for providing a communication service and a satellite broadcasting receiving service by coarsely tracking a target satellite in a mechanical fashion and finely tracking a target satellite in an electronic fashion.

DESCRIPTION OF RELATED ARTS

An effective antenna structure must be selected according to a required specification to develop a low price antenna that satisfies high gain antenna characteristics in a high frequency multi-band in a mobile satellite communication environment.

A conventional mechanical antenna system has been widely used to a single or a dual band mobile antenna system since the conventional mechanical antenna system has low gain characteristics and can be implemented in low cost. However, it is almost impossible to use the conventional mechanical antenna system to track a satellite, which requires high gain characteristics, because of narrowed antenna beam width such as narrower than 0.5°.

A conventional phase array antenna system has high-speed electron beam scanning characteristics but it requires expensive implementation cost. The phase array antenna system has been generally used as a single or dual band military antennal or a radar system. The implementation cost of the phase array antenna system is limited by an antenna gain, a scanning range of electron beam and sidelobe or grating lobe characteristics.

Hereinafter, problems of conventional antennas applicable to a hybrid antenna system in performance, cost and environment will be described.

In a view of a high gain antenna operated in multi-band and having narrow electron beam scanning range, the conventional phase array antenna has limitation of implementation and requires high implementation cost although a conventional phase array antenna has high-speed electron beam scanning characteristics. A conventional high gain mechanical antenna has degraded performance caused by tracking error of a target object although it requires less implementation cost.

A conventional single horn feed reflector antenna has been widely used in a long range satellite communication antenna system providing a fixed antenna beam. A reflector antenna is used at a small size antenna having a wider beam width since the conventional reflector antenna uses a mechanical beam tracking scheme. But, the reflector antenna has slower tracking speed compared to an electron beam tracking scheme. Due to the slower tracking speed, the reflector antenna is generally used in a ship or a low-speed mobile unit. However, it is almost impossible to use the reflector antenna for a mobile high gain antenna system since the reflector antenna generates greater tracking errors caused by a narrow beam width.

Since the conventional phase array antenna system tracks a target object in high speed using an electron beam, it is generally used in a military antenna system such as a radar system for high-speed and accurate tracking. However, the phase array antenna has limitations in cost, implementation and integration for an antenna specification requiring multi-band, high frequency, high gain and wider beam scanning sector.

Therefore, there is a great demand to develop a dual reflector offset hybrid antenna system having advantages of a mechanical antenna system and a phase array antenna system, which can coarsely track a target satellite in a mechanical fashion and finely track the target satellite in an electron fashion, in order to implement an offset hybrid antenna system that is mountable on a mobile unit, operated in multi-band and provides a satellite multimedia communication service and a satellite broadcasting receiving service.

SUMMARY OF THE INVENTION

It is, therefore, an object of the present invention to provide a hybrid antenna system capable of coarsely tracking a target satellite in mechanical fashion and finely tracking the target satellite in electron fashion to have advantages of both of a mechanical antenna system and a phase array antenna system.

It is another object of the present invention to provide a dual reflector type mobile hybrid antenna system having advantages of both of a mechanical antenna and a phase array antenna by including a reflector antenna having high gain characteristics and a feed active phase array antenna having high-speed beam scanning characteristics.

It is still another object of the present invention to provide a multi-band hybrid antenna system mountable on a moving unit and providing a satellite multimedia communication service and a satellite broadcasting receiving service.

In accordance with an aspect of the present invention, there is provided a multi-band hybrid antenna system for providing a communication service or/and a satellite broadcasting receiving service by coarsely tracking a target satellite in a mechanical fashion and finely tracking the target satellite in an electrical fashion, the multi-band hybrid antenna system including: a rotatory unit for tracking a satellite direction using a mechanical movement including a rotating motion and an electron beam tracking function and transmitting/receiving a multi-band frequency from a satellite through a free space; a stationary unit for communicating to an external terminal and/or transmitting and receiving a broadcasting signal from/to the external terminal; and a stabilizing means for connecting the rotatory unit to the stationary unit, and driving and controlling the rotatory unit in mechanical fashion and electrical fashion.

The rotatory unit may include: a main reflector disposed above the stabilizing means in parallel; a sub reflector disposed to be separated from the main reflector at a predetermined gap in free space as an intermedium; and an active feed array unit for inputting and outputting incident or radiated radio waves after doubly reflecting the radio waves by the main reflector and the sub reflector through electronically steering a beam within a predetermined beam width.

The stationary system may include: a second triplexer having multiple channels for performing a out-band signal restraining function, inputting and outputting a signal to/from the stabilizing means, performing a downlink frequency conversion on a broadcasting receiving band signal, providing the converted signal to an external terminal and providing a signal from the external terminal to the first triplexer; and a detecting/controlling means for controlling a phase of the transmitting/receiving active unit for electrically steering transmitting and receiving antenna beams, and detecting and controlling a state of an antenna.

The stabilizing means may include: an wave angel/azimuth angel driving unit for driving the stabilizing means to a wave angle direction and an azimuth angle direction of a sub reflector by using power and control data received from the power source/controlling unit; and a roll, pitch, yaw driving unit for driving the stabilizing means to a roll, a pitch and an yaw directions through a power and control data from the power source/controlling unit.

In accordance with another aspect of the present invention, there is also provided a multi-band hybrid antenna for providing a communication service and a satellite broadcasting receiving service, including: a communication band transceiving antenna having an offset dual reflector structure including a main reflector and a sub reflector to transmit and to receive a communication band signal; and a broadcasting receiving antenna disposed above the sub reflector in parallel for receiving a broadcasting band single.

In accordance with still another aspect of the present invention, there is also provided a method of tracking a satellite in a dual reflector structure hybrid antenna system using a mechanical driving device and an electron beam tracking scheme for coarsely tracking a target satellite in a mechanical fashion and finely tracking a target satellite in an electrical fashion, the method including the steps of: obtaining azimuth angle and wave angle information of a target satellite that provides a satellite communication and a satellite broadcasting at the hybrid antenna system; controlling a posture of the hybrid antenna system to constantly face an antenna beam to the target satellite using the mechanical driving device although a moving object mounting the hybrid antenna system is moved; acquiring a satellite signal by performing two-dimension mechanical scanning in a zig-zag manner at a sub reflector in the hybrid antenna system; and detecting a comparative position variation of the target satellite using an active phase array and continuously tracking the target satellite through performing a mechanical beam steering using the sub reflector and electron beam steering using an active phase array based on the detected position variation for continuously tracking the acquired satellite signal corresponding to movement of the moving object mounting the hybrid antenna system.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a hybrid antenna system will be described in more detail with reference to the accompanying drawings.

At first, an operating principle of triple band (Ka/K/Ku band) mobile unit mountable hybrid antenna system will be described as a preferred embodiment of the present invention.

A mobile unit mountable hybrid antenna operated in a triple band, i.e., Ka/K/Ku band, can provide a satellite multimedia communication service and a satellite broadcasting receiving service in a satellite communication environment. The Ka band is a transmitting frequency and K band is receiving frequency for satellite communication. The Ku band is a frequency band for receiving satellite broadcasting signal. Herein, it assumes that a Ka/K band satellite and a Ku band satellite are identical.

A hybrid antenna system according to the present invention has a hybrid structure of a reflector antenna having high-gain characteristics and a feed active phase array antenna having a high-speed electron beam scanning characteristics to have both advantageous characteristics. In the hybrid antenna system, the feed active phase array antenna forms current-distribution on an aperture surface of the reflector antenna, and the reflector reflects radio wave radiated from a phase array feeder and transforms the radio wave to a plane wave to shape a target beam pattern.

The hybrid antenna system according to the present invention has an offset hybrid antenna structure having a two-dimensional electron beam scan in order to implement a high gain mobile unit mountable antenna having a narrower beam width such as 0.5°. That is, the hybrid antenna system according to the present invention coarsely tracks a target satellite by a driving device, i.e., a stabilizer, and finely tracks the target satellite in high speed through 2-dimensional fine movement of a sub reflector.

Figure 1:
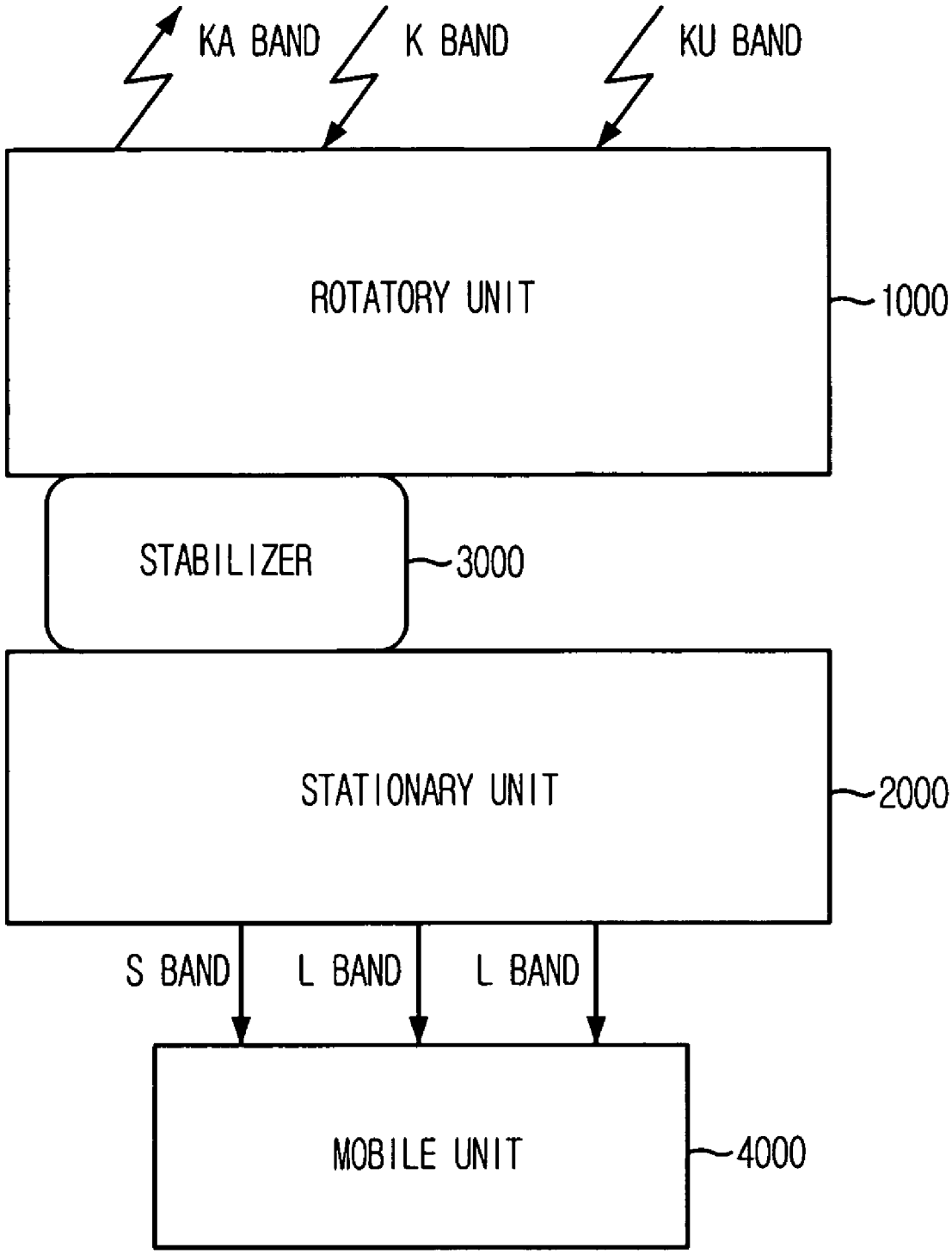
FIG. 1 is a block diagram illustrating a hybrid antenna system in accordance with a preferred embodiment of the present invention.

FIG. 1 is a block diagram illustrating a hybrid antenna system in accordance with a preferred embodiment of the present invention.

As shown in FIG. 1, the hybrid antenna system includes rotatory unit 1000, a stationary system 2000 and a stabilizer 3000.

The rotatory unit 1000 tracks a satellite direction using a mechanical movement including rotational motion and electron beam tracking. The rotatory unit 1000 transmits or receives triple band frequency signals, i.e., Ka, K and Ku band frequency signal, to/from a target satellite (not shown) through a free space.

The stationary system 2000 communicates with a mobile unit 4000 or transmits and receives broadcasting signals to/from the mobile unit 4000 through an S, or L band. Also, the stationary system 2000 receives AC power from an external device.

The stabilizer 3000 connects the rotatory unit 1000 and the stationary system 2000. The stabilizer 3000 controls and drives the rotatory unit 1000 in mechanical fashion and in electronic fashion.

Hereinafter, configuration and operations of the hybrid antenna system shown in FIG. 1 will be described in detail.

Figure 2:
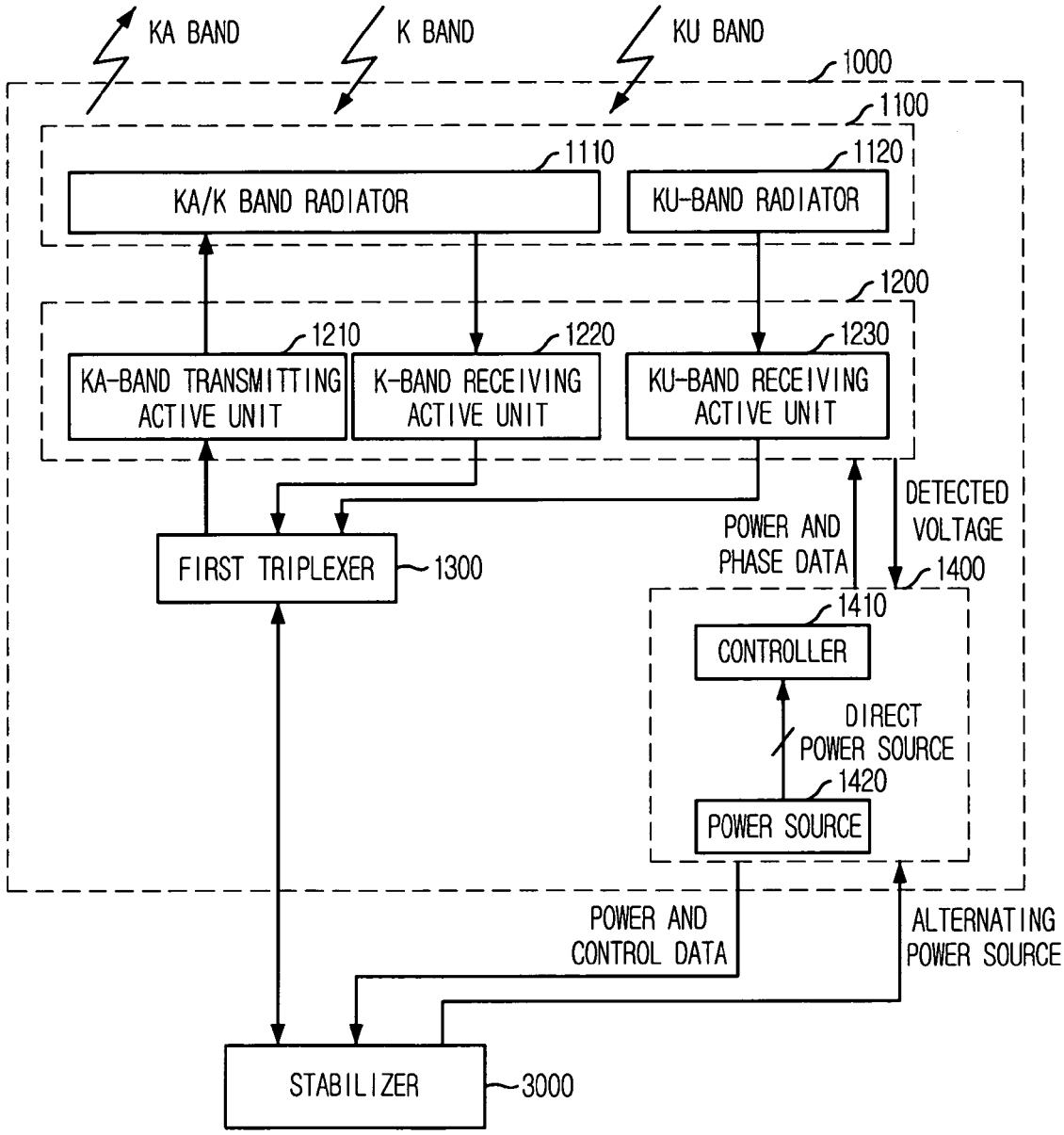
FIG. 2 is a block diagram showing the rotatory unit 1000 of FIG. 1.

FIG. 2 is a block diagram showing the rotatory unit 1000 of FIG. 1.

As shown in FIG. 2, the rotatory unit 1000 includes a radiating unit 1100, a triple band transceiving active unit 1200, a first triplexer 1300 and a power source/controller 1400.

The radiating unit 1100 includes a Ka/K band radiator 1110 and a Ku band radiator 1120. The radiating unit 110 receives signals of K band or Ku band frequency from a free space and transfers the received signals to the triple band transceiving unit 1200. Also, the radiating unit 1100 receives a Ka band signal from the triple band transceiving active unit 1200 and radiates the received signal to the free space.

Detailed configuration and operations of the radiating unit 1100 will be described in later.

The triple band transceiving active unit 1200 includes a Ka band transmitting active unit 1210, a K band receiving active unit 1220 and a Ku band transceiving active unit 1230. The triple transceiving active unit 1200 performs downlink frequency conversion on signals from the radiating unit 1100 and transfers the converted signal to the first triplexer 1300. Also, the triple transceiving active unit 1200 performs an uplink frequency conversion on signals from the first triplexer 1300 and transfers the converted signal to the radiating unit 1100. That is, the triple band transceiving active unit 1200 performs signal processing operations, such as controlling gain of signal power, amplifying low noise, controlling phase and shaping or controlling beam.

The Ku band receiving active unit 1230 is an active antenna disposed at a rare surface of each sofa type sub array of a Ku band flat plate array antenna. Ku band low noise amplifiers are used and the Ku band receiving active unit 1230 receives power through a RF coaxial cable. The Ka band transmitting active unit 1210 receives an S-band signal from the first triplexer 1300, performs uplink frequency conversion on the S-band signal, amplifies the converted signal and provides the amplified signal to the Ka/K band radiating unit 1110. It will be described in detail with reference to FIG. 10 in later. The K band receiving active unit 1220 receives a K band signal from the Ka/K band radiating unit 1110, performs downlink frequency conversion on the K band signal to an S-band signal and output the S-band signal to the first triplexer 1300. It will be described in detail with reference to FIG. 11 in later.

The triple band transceiving active unit 1200 is connected to the first triplexer 1300. The transmitting signal power outputted from the first triplexer 1300 is inputted to the Ka band transmitting active unit 1210, and the receiving signal power outputted from the K band receiving active unit 1220 and the Ku band receiving active unit 1230 is inputted to the first triplexer 1300.

The first triplexer 1300 is configured of three channels for inputting and outputting three band signals based on a common terminal. The first triplexer 1300 receives the downlink frequency converted signals from the triple band transceiving active unit 1200, processes the received signal and transfers the processed signal to the stabilizer 300. The first triplexer 1300 receives the uplink frequency converted signals from the stabilizer 3000, processes the received signals and transfers the processed signals to the triple band transceiving active unit 1200. The first triplexer 1300 performs a transmitting signal ON/OFF function of entire antenna system through a channel amplifying function, a signal restraining function and a switch.

The power source/controller 1400 includes a controller 1410 and a power source 1420. The power source/controller 1400 provides a power and a control data to the stabilizer 300 in order to drive and control the stabilizer 3000 by receiving AC power through the stabilizer 3000. The power source/controller 1400 also detects voltage from the triple band transceiving active unit 1200 and provides a power and a phase data to the triple band transceiving active unit 1200. The controller 1410 and the power source 1420 will be described in later with reference related drawings.

Figure 3:
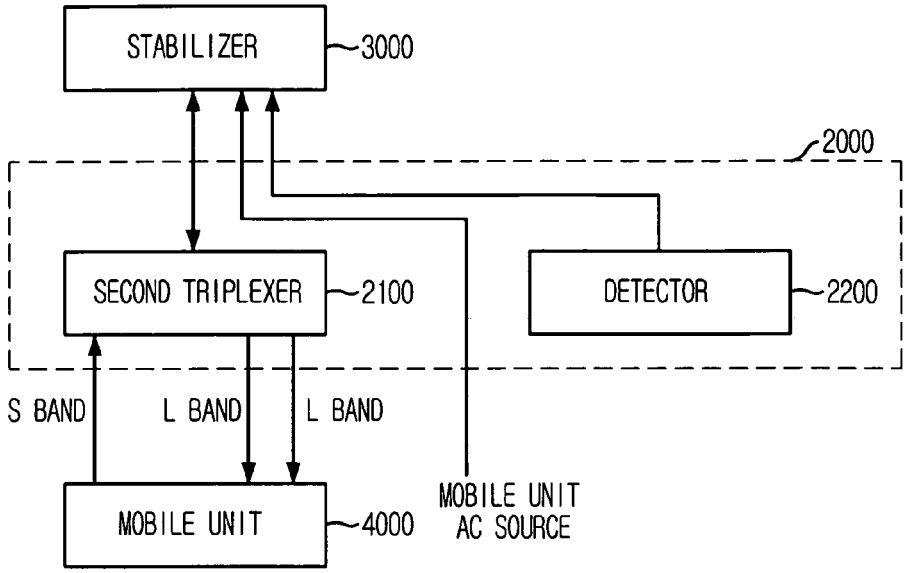
FIG. 3 is a block diagram of the stationary system 2000 shown in FIG. 1.

FIG. 3 is a block diagram of the stationary system 2000 shown in FIG. 1.

As shown in FIG. 3, the stationary system 2000 includes a second triplexer 2100 and a detector 2200.

The second triplexer 2100 has a similar structure compared to the first triplexer 1300. That is, the second triplexer 2100 is configured of three channels for inputting and outputting three band signals through a common terminal. The second triplexer 2100 receives a signal from the stabilizer 3000, performs a outer-band signal restraining function, performs a downlink frequency conversion on the Ku band signal to a L-band signal, transfers the L-band signal to the mobile unit 4000 and receives the S-band signal from the mobile unit 4000.

The detector 2200 controls phases of the Ka band transmitting active unit 1210, the K band receiving active unit 1220 and the Ku band receiving active unit 1230 for controlling a direction of electron beam of transmitting and receiving antenna. Also, the detector 2200 detects and controls a state of the antenna.

Figure 4:
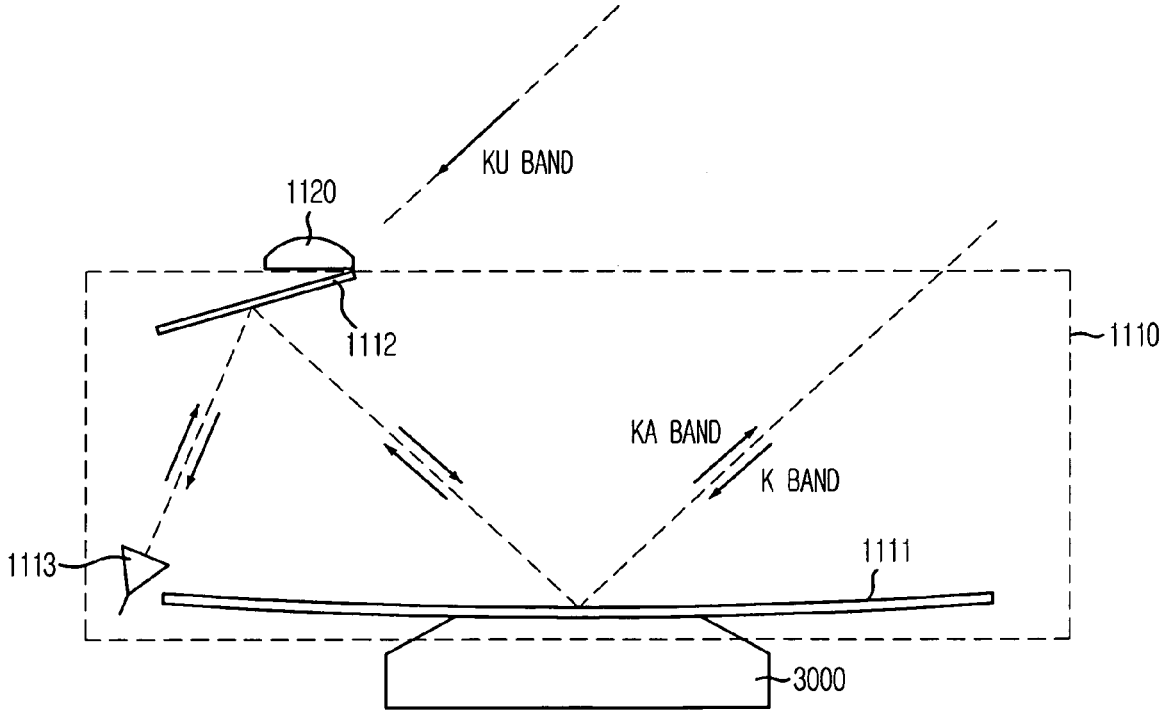
FIG. 4 is a side view of the radiating unit 1100 shown in FIG. 2.

FIG. 4 is a side view of the radiating unit 1100 shown in FIG. 2.

As shown in FIG. 4, the radiating unit 1100 of the hybrid antenna system includes the Ka/K band radiating unit 1110 and the Ku band radiating unit 1120.

The Ka/K band radiating unit 1110 is an offset dual reflector antenna. The Ka/K band radiating unit 1110 includes a main reflector 1111, a sub reflector 1112 and an active feed array 1113, which are disposed above the stabilizer 3000. An incident/radiated radio wave, which is shown as a dotted line in FIG. 4, is inputted to or outputted from the active feed array 1113 after doubly reflected by the sub reflector 1112 and the main reflector 1111. Herein, the main reflector 1111 is disposed on the stabilizer 3000 in parallel in the present embodiment. Accordingly, a motion load of the stabilizer 300 is reduced by lowering a center of gravity of the antenna system.

The Ku band radiating unit 1120 has a flat plate array antenna structure configured by arranging sofa type sub array antennas in a wave angle, which allows a height of the entire antenna system to be lowered, and disposed above the sub reflector 1112 in parallel.

Since the Ku band flat plate array antenna generally has a comparatively wider antenna beam width, for example, 6 times wider than the Ka/K band, the Ku band flat plate array antenna can track a target satellite with a satellite tracking error range less than a 3 dB (TBC) although the Ku band flat plate array antenna is controlled only by a mechanical phase tracking motion of the stabilizer 3000. Therefore, the Ku band radiator 1120 should be disposed above a supporting member (not shown) on the sub reflector 1112 in parallel and the supporting member of the sub reflector 1112 is moved with the supporting member (not shown) of the main reflector 1111.

The apertures of the main reflector 1111 and the sub reflector 1112 are optimized to have a curvilinear rim shape in order to reduce an entire size of the antenna.

Figure 5A:
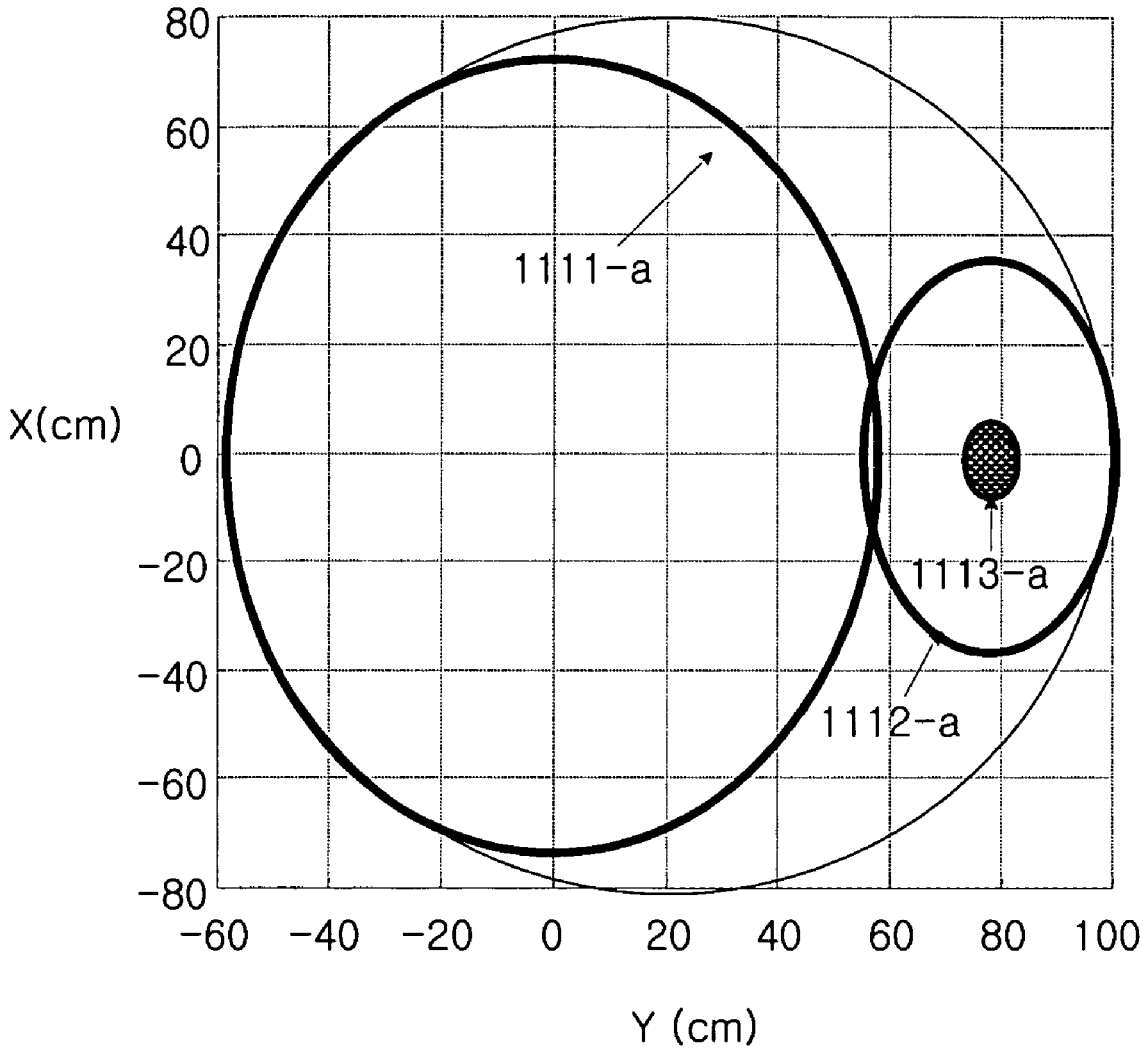
FIG. 5 is a top view and a side view of the radiating unit 1100 shown in FIG. 1.
Figure 5B:
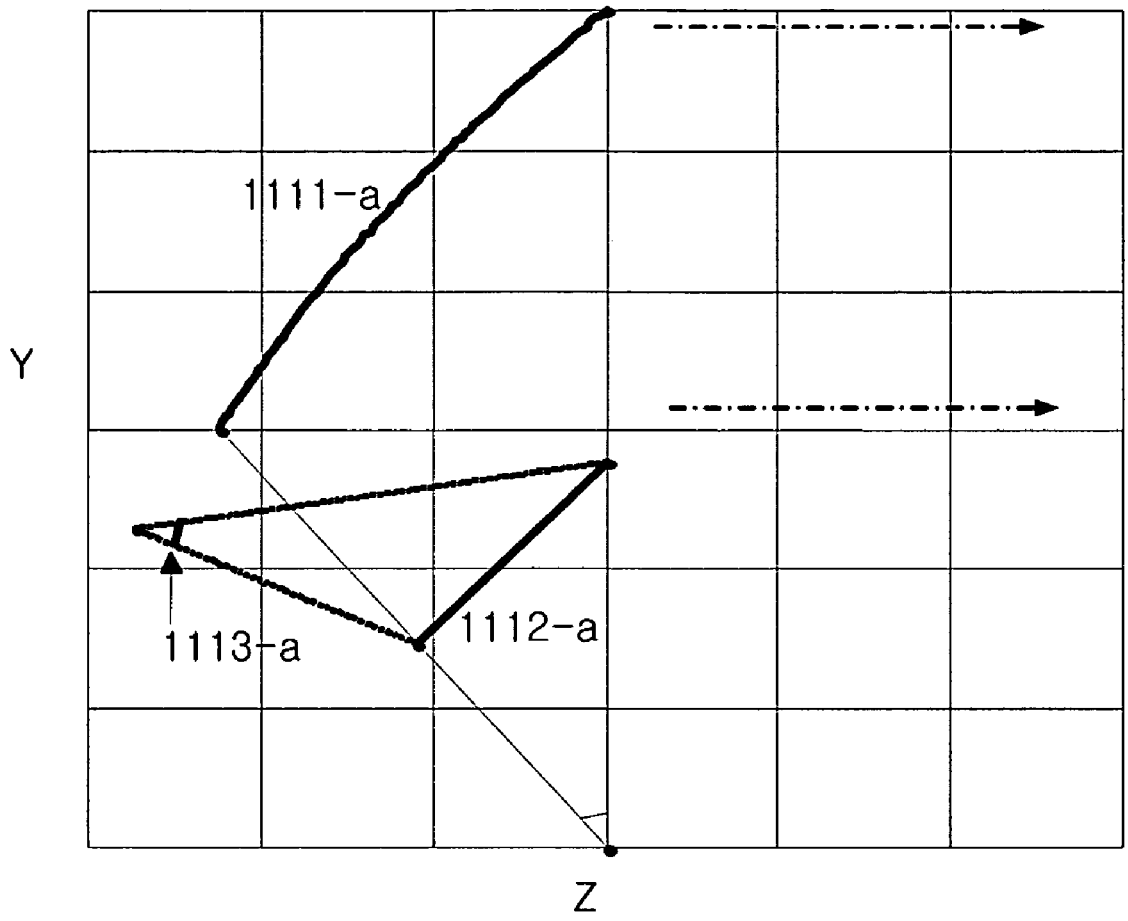

FIG. 5 is a top view and a side view of the radiating unit 1100 shown in FIG. 1.

As shown in the top view (a) of FIG. 5, the radiating unit according to a first embodiment includes a main reflector 1111-*a*, a sub reflector 1112-*a* and an active feed array 1113-*a*, which are arranged in a limited circle.

Also, edges of the sub reflector 1112-*a* and the active feed array 1113-*a* have a modified oval shape and the surface of the sub reflector 1112-*a* is a flat plate shape.

The side view (b) of the sub reflector 1112-*a* in FIG. 5 clearly shows the flat plate shape surface.

Figure 6A:
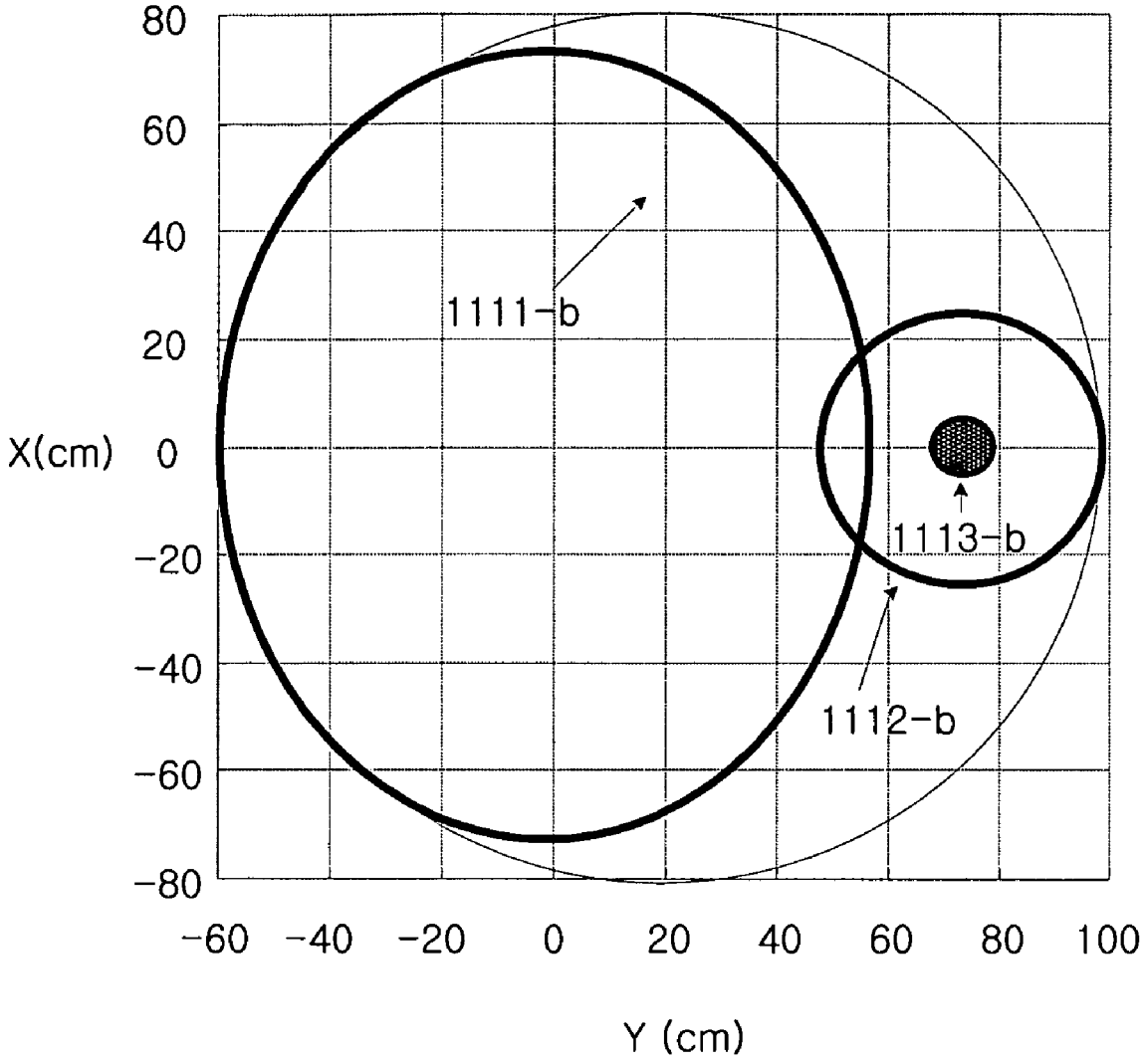
FIG. 6 is a top view and a side view of radiating unit 1100 in accordance with a second embodiment of the present invention.
Figure 6B:
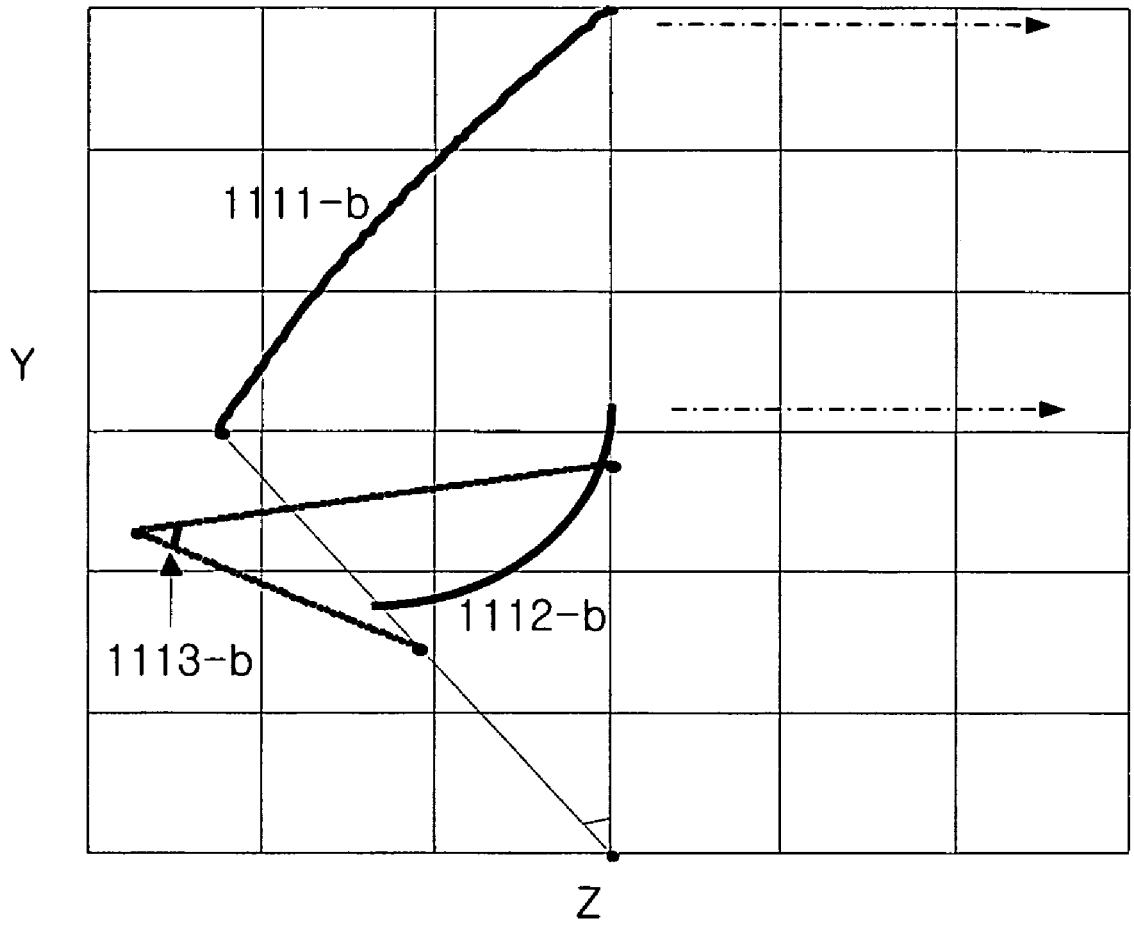

FIG. 6 is a top view and a side view of radiating unit 1100 in accordance with a second embodiment of the present invention.

As shown in the top view (a) of FIG. 6, the radiating unit 1100 according to the second embodiment includes a main reflector 1111-*b*, a sub reflector 1112-*b* and an active feed array 1113-*b*.

Edges of the sub reflector 11120-*b* and the active feed array 1113-*b* have a circular shape and a surface of the sub reflector 1112-*b* is properly shaped.

The side view (b) of the sub reflector 1112-*b* in FIG. 6 clearly shows the shaped surface.

In the radiating unit 1110 according to the first and the second embodiments, if the radiating units 1110 of the first and the second embodiments have the same aperture shape of the main reflectors, similar size of sub reflectors and the same number of feed arrays, the radiating units 1110 of the first and the second embodiments provide very similar electric characteristics. Hence, the present invention will be described based on the radiating unit 1110 according to the first embodiment. However, the present invention can be identically applied to the radiating unit according to the second embodiment.

Figure 7:
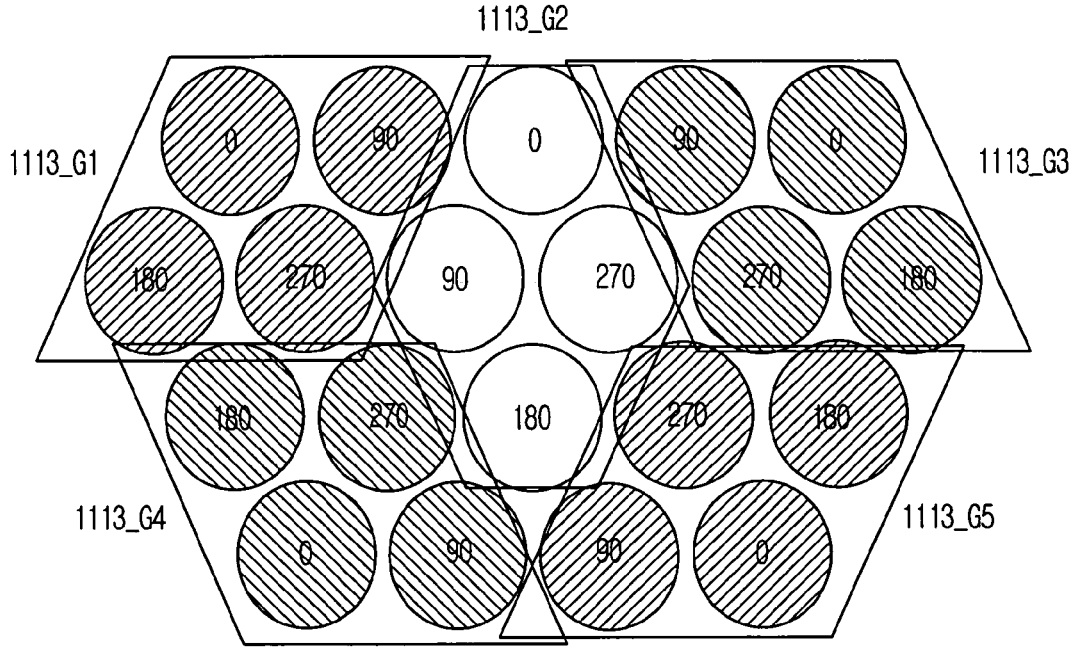
FIG. 7 shows the active feed array 1113 shown in FIG. 4.

FIG. 7 shows the active feed array 1113 shown in FIG. 4. That is, FIG. 7 shows arrangement of feed array elements.

As shown in FIG. 7, the aperture of the active feed array 1113 is a modified oval shape, and includes 20 array elements. Since the number of the array elements is decided according to the antennal gain and antenna beam scanning range, it is obvious to those skilled in the art that the number of the array elements is variable.

The aperture of the unit array element in the active feed array 1113 can be shaped as a circular shape or a rectangle shape and the shape of the aperture is reflected on the antenna design.

In the active feed array 1113 shown in FIG. 7, the array elements each having a circular aperture are divided 5 groups 113-G1 to 1113-G5 each having 4 array elements. In order to improve the cross polarization characteristics, the array elements are symmetrically arranged in right and left, and up and down directions around a center group 1113-G2. Numeral references in each circles 0, 90, 180, 270 denote a rotation direction excited in each terminal.

Figure 8:
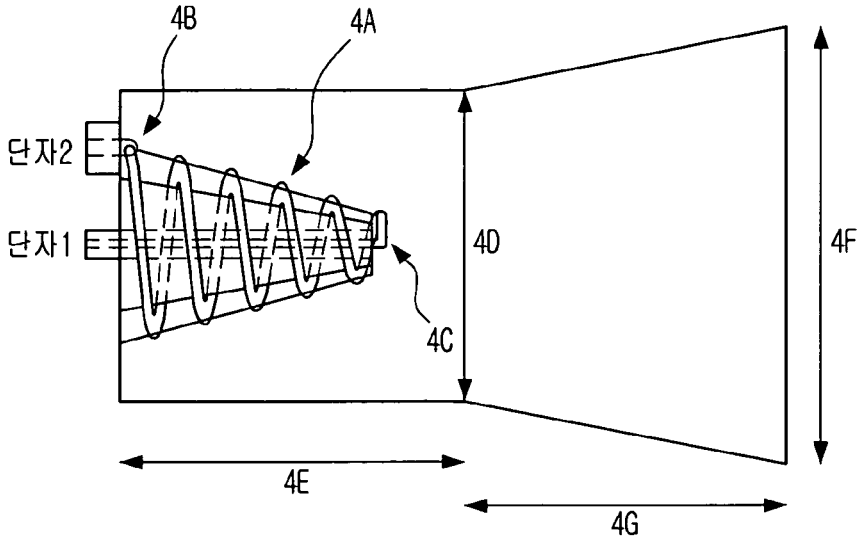
FIG. 8 shows a structure of dual band cone shape helix exciting element according to an embodiment of the present invention.
Figure 9:
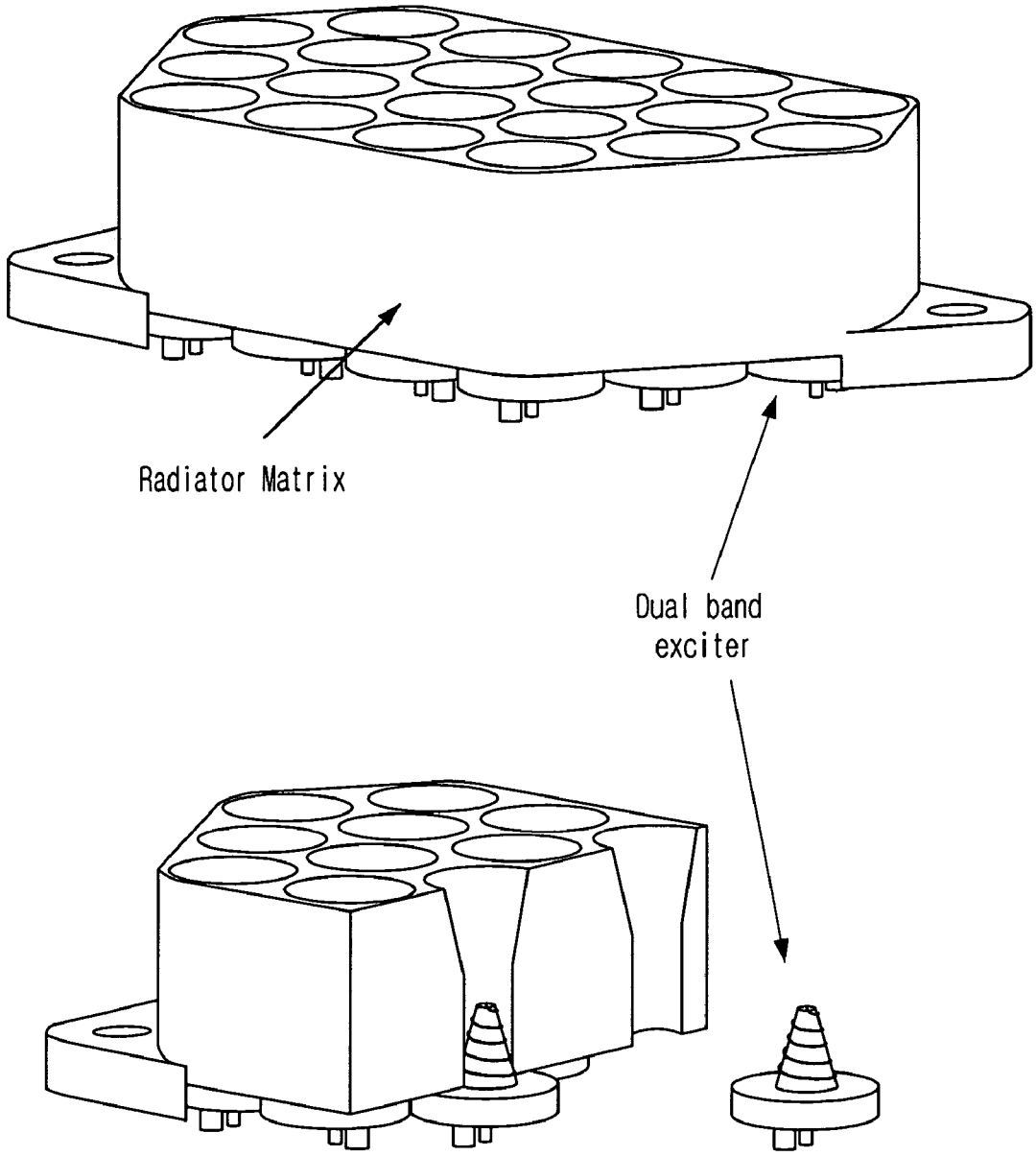
FIG. 9 shows arrangement of 20 feed arrays using a cone shape helix exciting element according to the present invention.

FIG. 8 shows a structure of dual band cone shape helix exciter according to an embodiment of the present invention, and FIG. 9 shows arrangement of 20 feed arrays using a cone shape helix exciter according to the present invention.

As shown in FIG. 8, the feed array elements of the active feed array 1113 according to the present invention have a dual band cone shape helix (4*a*) exciter structure. The dual band denotes Ka band and K band. However, such an exciting structure can be used in other frequency bands.

A transmitting band signal, i.e., Ka band signal, of a first terminal 1 is inputted through a coaxial cable in a center of a circular wave guide 4*d*. The inputted signal is connected to a helix at a contact point 4*c* and is excited as a right polarized backward propagation wave. The excited wave is reflected to a bottom surface of a conductive material and converted to a left polarized forward propagation wave. And, the converted wave is radiated to a sub reflector through an extended circular wave guide 4*f*.

On the contrary, a receiving band signal, i.e., K band signal, is inputted from the sub reflected as a right polarized wave and directly outputted to a second terminal 2 through the connected cone shape helix 4*a*. Herein, the transmitting and receiving signals become different circular polarized signals and the transmitting and receiving polarized waves can be changed according to a target specification.

Figure 10:
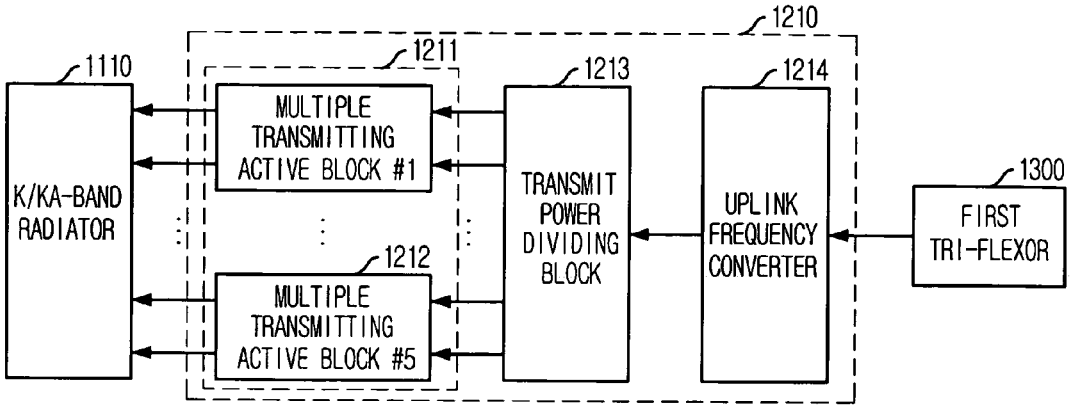
FIG. 10 is a block diagram illustrating the Ka band transmitting active unit 1210 shown in FIG. 2.

FIG. 10 is a block diagram illustrating the Ka band transmitting active unit 1210 shown in FIG. 2.

As shown in FIG. 10, the Ka band transmitting active unit 1210 according to the present invention includes a transmitting active module 1211 configured of 5 multiple transmitting active blocks 1212, a transmitting power dividing block 1213 and a up-link frequency converter 1213. The Ka band transmitting active unit 1210 receives an S-band signal from the first triplexer 1300, performs an uplink frequency conversion on the S-band signal, amplifies the converted frequency signal and provides the amplified frequency signal to the Ka/K band radiating unit 1110.

The uplink frequency converter 1214 also changes an intensity of signal power to control a gain.

The transmitting power dividing block 1213 receives a signal power through a one input terminal from the uplink frequency converter 1214 and uniformly distributes the signal power to 5 output terminals.

The transmitting active module 1211 is disposed at an end portion of the Ka band transmitting active unit 1210 and includes five multiple transmitting active blocks 1212. Each of the multiple transmitting active blocks 1212 uniformly distributes a signal power inputted through a single input terminal to four output terminals. The multiple transmitting active blocks 1212 control a gain of the signal power, amplify the signal power and control the phase.

Therefore, the transmitting active module 12111 is configure of 20 transmitting channels through five multi transmitting active blocks 1212 each having four channels, and shapes and controls transmitting beam of the antenna system through $1^{st}$ level transmitting phase shifters in each channel.

Figure 11:
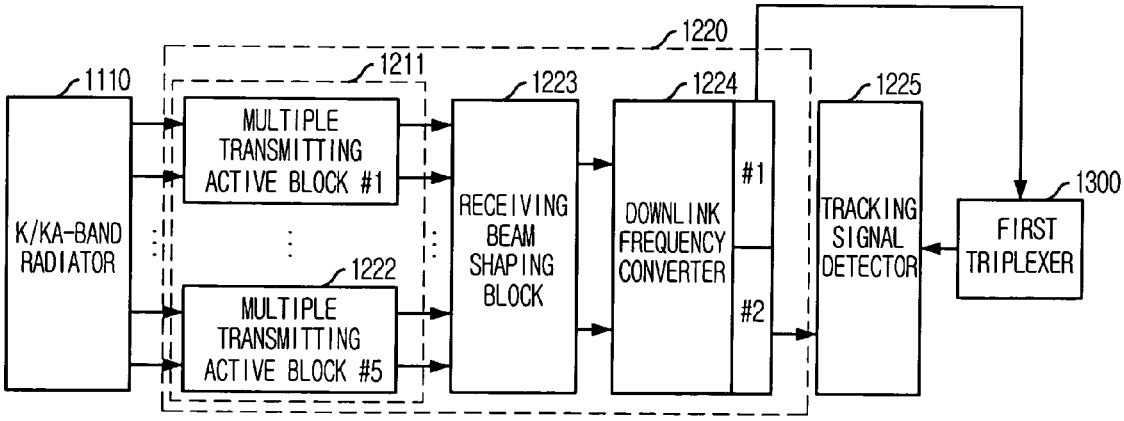
FIG. 11 is a block diagram of the K band receiving active unit 1220 shown in FIG. 2.

FIG. 11 is a block diagram of the K band receiving active unit 1220 shown in FIG. 2.

As shown in FIG. 11, the K band receiving active unit 1220 includes a receiving active module 1221 having 5 multiple receiving active blocks 1222, a receiving beam shaping block 1223, a downlink frequency converter 1224 and a tracking signal detector 1225. The K band receiving active unit 1220 receives a K band signal from the Ka/K band radiating unit 1110 and outputs an S-band signal to the first triplexer 1300 by performing downlink frequency conversion on the K band signal to convert downlink frequency signal to the S band signal.

The receiving active module 1221 disposed at the input terminal of the K band receiving active unit 1220 is configured of five multiple receiving active blocks 1222. Each of the multiple receiving active blocks 1222 performs a power combining function that combines signal power inputted through four terminals and outputs the combined signal power to a single output terminal, and performs a gain control function, a low noise amplifying function and a phase control function.

Therefore, the receiving active module 1221 is configured of 20 receiving channels through five multi receiving active blocks 1222 each having four channels. The receiving active module 1221 shapes and controls a receiving beam of the antenna system through $1^{st}$ level receiving phase shifters in each of the channels.

The receiving beam shaping block 1223 has 5 input terminals connected to the five multiple receiving active blocks 1222 and two output terminals. One of the outputting terminals is connected to the downlink frequency converter 1224 and transfers signals to the mobile unit 4000. Other terminal is connected to the downlink frequency converter 1224 and the tracking signal detector to use for tracking a satellite position. Also, the receiving beam shaping block 1223 is configured of 5 channels. The receiving beam shaping block 1223 controls phases through $2^{nd}$ level phase shifters in each channels, and shapes and controls tracking beams for tracking the satellite.

The hybrid antenna system according to the present invention sequentially forms four tracking beams offset around a main beam by the $2^{nd}$ level phase shifters in the receiving beam shaping block 1223 and uses the formed four tracking beams for tracking a target satellite.

The downlink frequency converter 1224 includes a first downlink frequency converter #1 and a second downlink frequency converter #2 each performing a same function. The downlink frequency converter 1224 control a gain varied according to the intensity of the signal power as well as downlink converting the inputted K band signal to the S band signal.

The tracking signal detector 1225 detects an IF signal power inputted from the downlink frequency converter 1223

#2 as a voltage type and transfers the level of detected voltage to the controller for determining a position of a target satellite.

Figure 12:
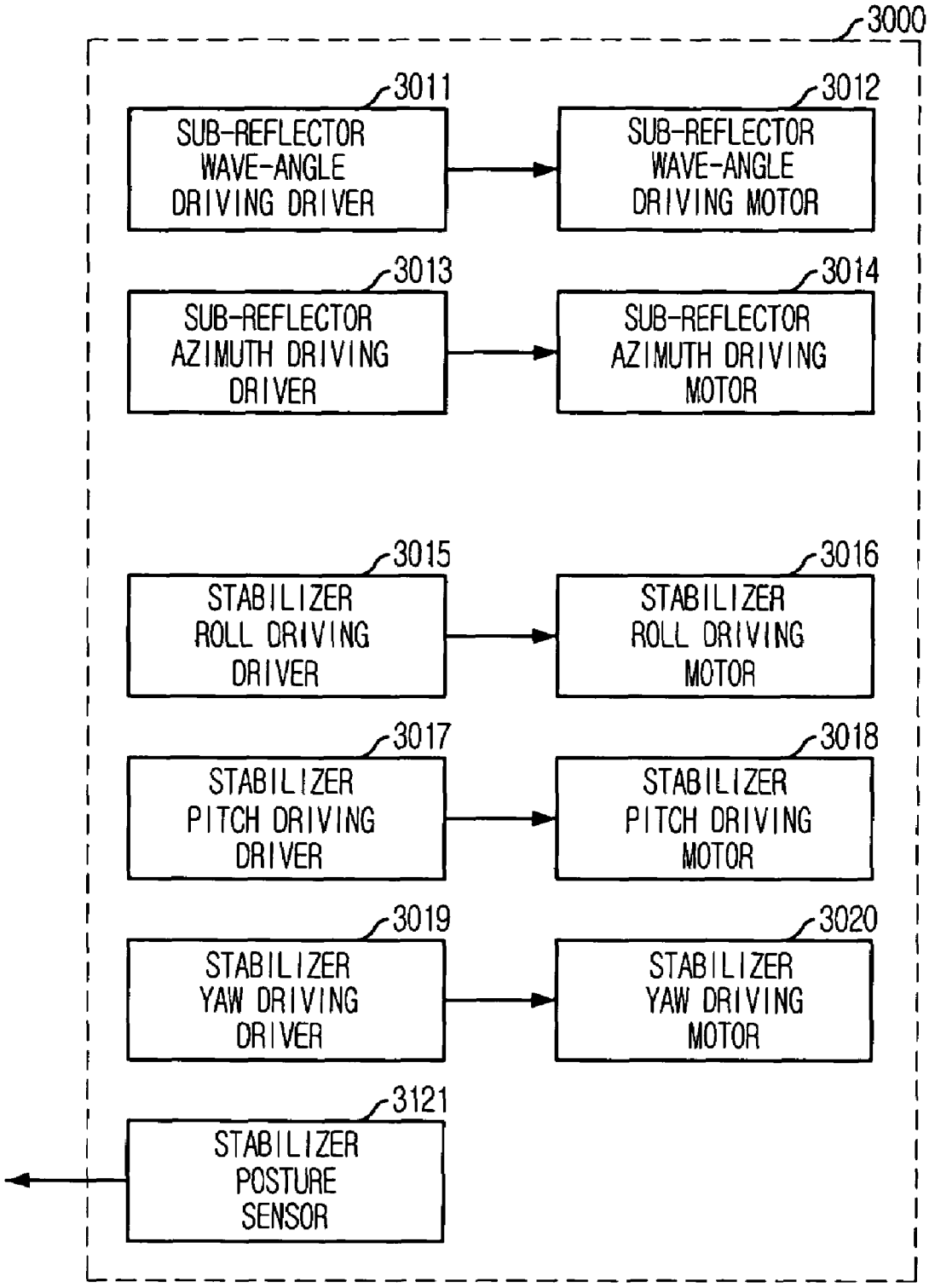
FIG. 12 is a block diagram of the stabilizer 3000 shown in FIG. 1.

FIG. 12 is a block diagram of the stabilizer 3000 shown in FIG. 1.

As shown in FIG. 12, the stabilizer 3000 includes a sub-reflector wave-angel driving driver 3011, a sub-reflector azimuth angle driving driver 3013, a sub-reflector wave angle driving motor 3012 and a sub-reflector azimuth angle driving motor 3014 for driving the stabilizer 300 in a direction of a wave angle and azimuth angle of the sub reflector. The stabilizer 3000 also includes a stabilizer roll driving driver 3015, a stabilizer pitch driving driver 3017, a stabilizer yaw driving driver 3019, a stabilizer roll driving motor 3016, a stabilizer pitch driving motor 3018, and a stabilizer yaw driving motor 3020 for driving the stabilizer in a roll direction, a pitch direction and a yaw direction. The stabilizer 3000 further includes a stabilizer posture sensor 3021 for sensing a posture of the stabilizer 3000 using exterior posture sensing information of a slop sensor of a main reflector and each speed sensor.

Figure 13:
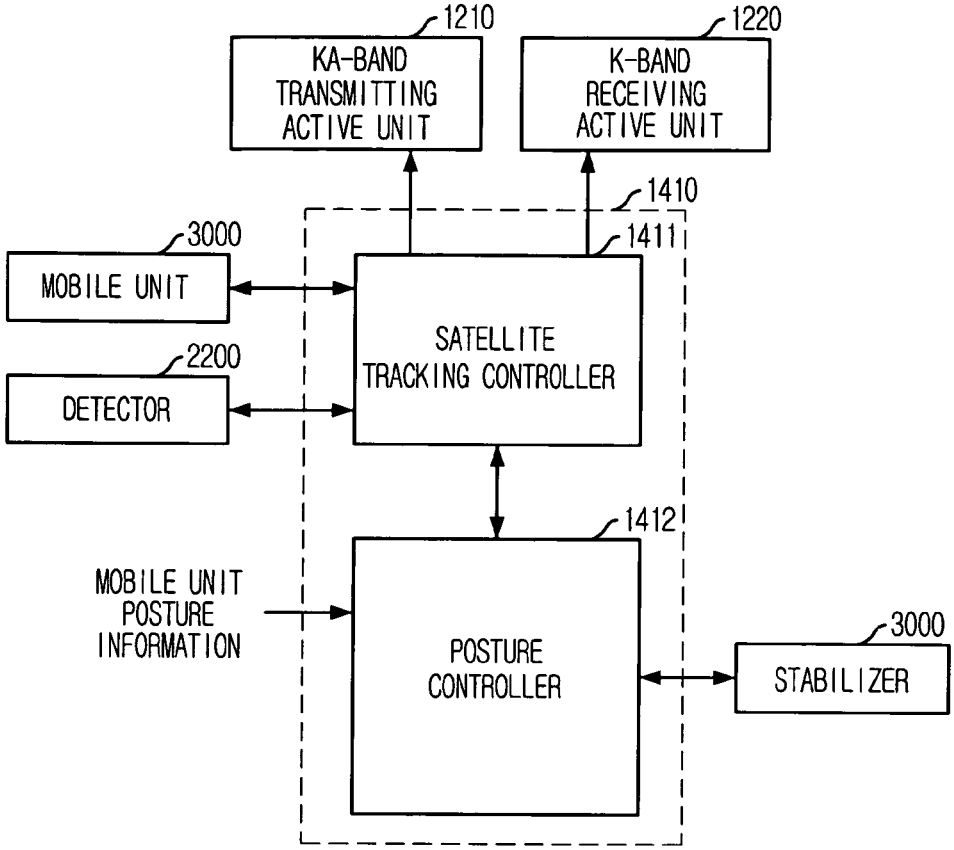
FIG. 13 is a block diagram of the controller 1410 shown in FIG. 2.

FIG. 13 is a block diagram of the controller 1410 shown in FIG. 2.

As shown in FIG. 13, the controller 1410 according to the present invention includes a satellite tracking controller 1411 and a posture controller 1412.

The satellite tracking controller 1411 is connected to the detector 2200 and transfers an antenna state to the detector 2200. The satellite tracking controller 1411 also receives a command from a user. The satellite tracking controller 1411 provides the antenna state information to the mobile unit 4000 and receives commands from the mobile unit 4000. The satellite tracking controller 1412 transfers a posture control command to the posture controller 1412 and receives the state information of the stabilizer.

The posture controller 1412 receives the posture control command from the satellite tracking controller 1411 and receives the stabilizer posture information from the stabilizer posture sensor 3011 of the stabilizer 3000. Also, the posture controller 1412 receives the mobile posture information from a mobile posture sensor such as a gyro or a GPS, and controls the posture of the stabilizer 3000 through driving drivers 3011, 3013, 3015, 3017 and 3019 of the stabilizer 3000 to face around a target satellite corresponding to the movement of the mobile unit.

Figure 14:
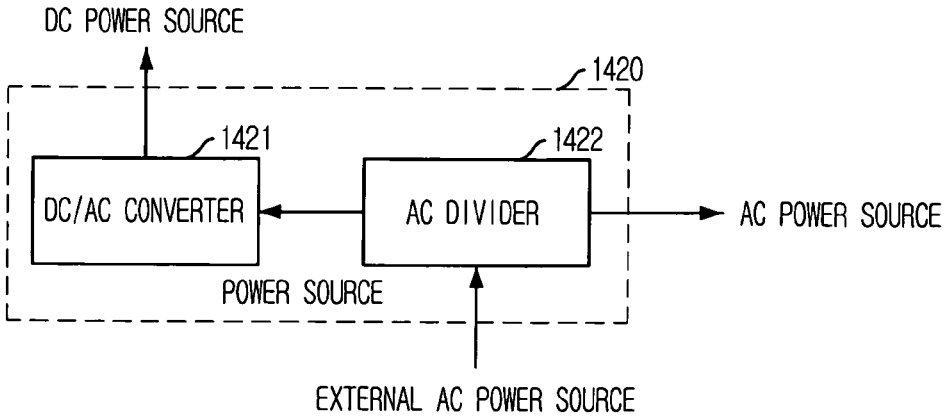
FIG. 14 is a block diagram showing a power source 1420 shown in FIG. 12.

FIG. 14 is a block diagram showing a power source 1420 shown in FIG. 12.

As shown in FIG. 14, the power source 1420 according to the present invention includes an AC power divider 1422 for receiving an AC power from an external mobile unit and dividing the received AC power to a plurality of AC power terminals, and an AC-to-DC converter 1421 for converting the divided AC power to DC power.

The AC power divider supplies the divided AC power to the driving drivers 3011, 3013, 3015, 3017 and 3019 of the stabilizer 3000. Other units directly receive DC power from the AC-to-DC converter 1421 or from the satellite tracking controller 1411.

Figure 15:
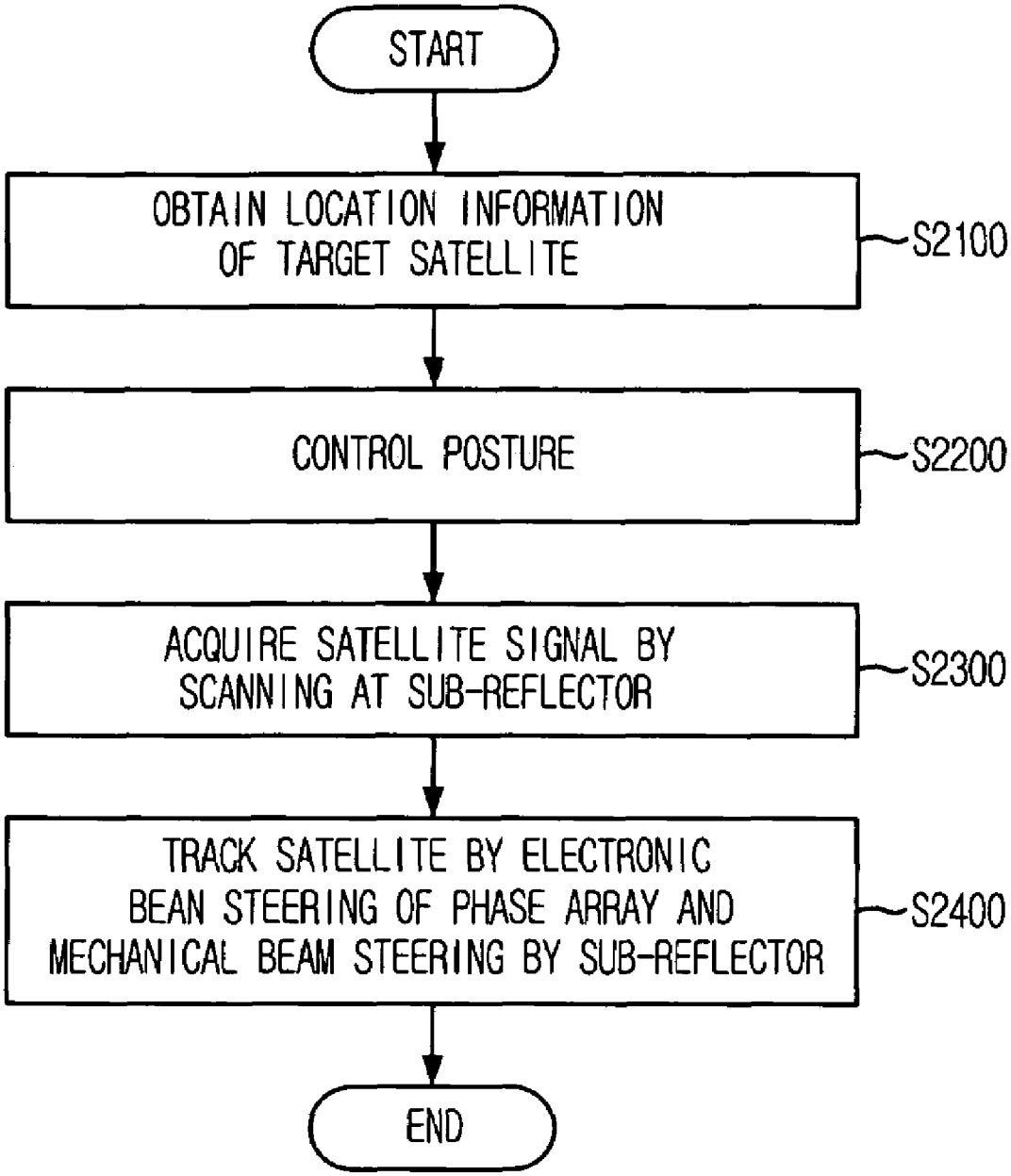
FIG. 15 is a flowchart of a method of tracking a target satellite in a hybrid antenna system in accordance with a preferred embodiment of the present invention

FIG. 15 is a flowchart of a method of tracking a target satellite in a hybrid antenna system in accordance with a preferred embodiment of the present invention.

Referring to FIG. 15, the hybrid antenna system obtains azimuth angle information and wave angle information of a target satellite that provides the satellite communication service or the satellite broadcasting service at step S2100.

Then, the mechanical driving units of the stabilizer 3000 controls the posture of the hybrid antenna system to face the antenna beam to the target satellite continuously although the mobile unit is moving at step S2200.

The sub reflector of the hybrid antenna system performs mechanical 2-dimensional scanning in a zig-zag manner to acquire the satellite signal at step S2300.

Then, the hybrid antenna system continuously tracks the target satellite by detecting a comparative position variation of a target satellite using the active phase array and controlling the mechanical beam steering using the sub reflector and an electron beam steering using the active phase array based on the detected comparative position variation in order to continuously track the acquired satellite signal at step S2400.

The above described method according to the present invention can be embodied as a program and stored on a computer readable recording medium. The computer readable recording medium is any data storage device that can store data which can be thereafter read by the computer system. The computer readable recording medium includes a read-only memory (ROM), a random-access memory (RAM), a CD-ROM, a floppy disk, a hard disk and an optical magnetic disk.

As described above, the hybrid antenna system according to the present invention has advantages of a mechanical antenna and a phase array antenna by coarsely tracking a target satellite in mechanical fashion and finely tracking the target satellite in high speed in electronic fashion.

Also, the hybrid antenna system can be mounted on a moving object to receive a satellite multimedia communication service and a satellite broadcasting receiving service.

Furthermore, the hybrid antenna system according to the present invention can be implemented as a triple band two-dimensional hybrid antenna system having high-speed electron beam tracking characteristics of a phase array antenna and high gain characteristics of reflector antenna.

Moreover, improved technology for shaping of antenna structure of main reflector and sub reflector, a dual band exciter structure, a feed array, a configuration of transmitting/receiving active units and a satellite tracking algorithm are provided through the hybrid antenna system according to the present invention.

In addition, a multi-band high gain mobile antenna can be economically implemented using the hybrid antenna system according to the present invention.

The hybrid antenna system can be mounted at the moving object for receiving a Ka/K band satellite multimedia communication service and a Ku band satellite broadcasting receiving service through a still orbit satellite.

The present application contains subject matter related to Korean patent application Nos. KR 2004-00102360 and 2005-0042713, filed with the Korean patent office on Dec. 7, 2004, and May 20, 2005, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A multi-band hybrid antenna system for providing a communication service or/and a satellite broadcasting receiving service by coarsely tracking a target satellite in a mechanical fashion and finely tracking the target satellite in an electrical fashion, the multi-band hybrid antenna system comprising:

a rotatory unit for tracking a satellite direction using a mechanical movement including a rotating motion and an electron beam tracking function and transmitting/receiving a multi-band frequency from a satellite through a free space;

a stationary unit for communicating to an external terminal and/or transmitting and receiving a broadcasting signal from/to the external terminal; and a stabilizing means for connecting the rotatory unit to the stationary unit, and driving and controlling the rotatory unit in the mechanical fashion and the electrical fashion.

2. The multi-band hybrid antenna system as recited in claim 1, wherein the rotatory unit includes:

a main reflector disposed above the stabilizing means in parallel;

a sub reflector disposed to be separated from the main reflector at a predetermined gap in free space as an intermedium; and an active feed array unit for inputting and outputting incident or radiated radio waves after doubly reflecting the radio waves by the main reflector and the sub reflector through electronically steering a beam within a predetermined beam width.

3. The multi-band hybrid antenna system as recited in claim 2, wherein the main reflector is mechanically moved by cooperating with the stabilizing means, and the sub reflector is mechanically moved with the main reflector and is independently moved within a predetermined width in up, down, right and left directions.

4. The multi-band hybrid antenna system as recited in claim 3, wherein apertures of the main reflector and the sub reflector have a curvilinear rim structure.

5. The multi-band hybrid antenna system as recited in claim 4, wherein the main reflector, the sub reflector and the active feed array unit are disposed within a limited circle when they are observed from a top elevation position.

6. The multi-band hybrid antenna system as recited in claim 5, wherein edges of the sub reflector and the active feed array unit have a modified oval shape and a surface of the sub reflector has a flat plate shape.

7. The multi-band antenna system as recited in claim 6, wherein the edges of the sub reflector and the active feed array unit have a circular shape and the surface of the sub reflector has a shaped surface.

8. The multi-band hybrid antenna system as recited in claim 7, wherein the active feed array unit includes a plurality of array elements divided into predetermined groups and the plurality of array elements are arranged in up, down, right and left direction based on a center group of the plurality of array elements in order to improve a cross polarization characteristic.

9. The multi-band hybrid antenna system as recited in claim 8, wherein an array element in the plurality of array elements is a dual band cone shape helix exciter.

10. The multi-band hybrid antenna system as recited in claim 9, wherein the dual band cone shape helix exciter includes a cone shape conductive material having both end points connected to a transmitting terminal and a receiving terminal in order to be operated as a circular polarization of different frequencies.

11. The multi-band hybrid antenna system as recited in claim 10, wherein the stationary system includes:

a second triplexer having multiple channels for performing an out-band signal restraining function, inputting and outputting a signal to/from the stabilizing means, performing a downlink frequency conversion on a broadcasting receiving band signal, providing the converted signal to an external terminal and providing a signal from the external terminal to the first triplexer; and a detecting/controlling means for controlling a phase of the transmitting/receiving active unit for electrically steering transmitting and receiving antenna beams, and detecting and controlling a state of an antenna.

12. The multi-band hybrid antenna system as recited in claim 1, wherein the stabilizing means includes:

a wave angel/azimuth angle driving unit for driving the stabilizing means to a wave angle direction and an azimuth angle direction of a sub reflector by using power and control data received from a power source/controlling unit; and a roll, pitch, yaw driving unit for driving the stabilizing means to a roll, a pitch and a yaw direction through a power and control data from the power source/controlling unit.

13. The multi-band hybrid antenna system as recited in claim 12, wherein the wave angle/azimuth angle driving unit includes:

a wave angle driving motor for driving the stabilizing means to a wave angle direction of a sub reflector;

a wave angle motor driving means for controlling and driving the wave angle driving motor;

an azimuth angle driving motor for driving the stabilizing means in an azimuth angle of a sub reflector;

an azimuth angle motor driving means for controlling and driving the azimuth angle driving motor; and a stabilizing means posture sensor for sensing a posture of the stabilizing means.

14. The multi-band hybrid antenna system as recited in claim 12, wherein the roll, pitch, yaw driving unit includes:

a roll driving motor for driving the stabilizing means in the roll direction;

a roll motor driving means for controlling and driving the roll driving motor;

a pitch driving motor for driving the stabilizing means in the pitch direction;

a pitch motor driving means for controlling and driving the pitch driving motor;

a yaw driving motor for driving the stabilizing means to the yaw direction; and a yaw motor driving means for controlling and driving the yaw driving motor.

15. The multi-band hybrid antenna system as recited in claim 1, wherein the rotatory unit includes:

a radiating means for receiving a signal of a communication receiving band from the free space using a main reflector and a sub reflector, radiating a signal of a communication transmitting band and receiving a signal of broadcasting receiving band;

a transceiving active unit for performing a downlink frequency conversion on a signal inputted from the radiating means, performing an uplink frequency conversion on the signal inputted from the radiating means and providing the uplink frequency converted signal to the radiating means and performing a signal processing function;

a first triplexer having multiple channels that input/output a multi-band signal through a common terminal, receiving the downlink frequency converted signal from the transceiving active unit, processing the received signal and providing the processed signal to the stabilizing means, and receiving a signal from the stabilizing means, processing the received signal and providing the processed signal to the transceiving active unit; and a power source/controlling unit for providing power and control data to the stabilizing means to drive and to control the stabilizing means by receiving an AC supply power, and detecting a voltage from the transceiving active unit and providing a power and phase data to the transceiving active unit.

16. The multi-band hybrid antenna system as recited in claim 15, wherein the radiating means includes:

a communication band transceiving radiating unit having an offset dual reflector antenna structure for transmitting and receiving a communication band signal; and a broadcasting band receiving radiating unit disposed above the sub reflector in parallel to receive a broadcasting band signal.

17. The multi-band hybrid antenna system as recited in claim 16, wherein the broadcasting band receiving radiating unit has a flat plate array antenna structure and includes sub array antennas each having a sofa structure which are arranged in a wave angle direction.

18. The multi-band hybrid antenna system as recited in claim 17, wherein the communication band transceiving radiating unit includes:

a main reflector disposed above the stabilizing means in parallel;

a sub reflector disposed to be separated from the main reflector at a predetermined gap in the free space as an intermedium; and an active feed array unit for outputting and inputting an incident or radiated radio wave after doubly reflecting the radio wave on the main reflector and the sub reflector.

19. The multi-band hybrid antenna system as recited in claim 16, wherein the transceiving active unit includes:

a broadcasting band receiving active unit for amplifying a received broadcasting signal using a broadcasting band low nose amplifier and outputting the amplified signal;

a communication band transmitting active unit for receiving a signal from the first triplexer, performing an uplink frequency conversion on the received signal to convert the received signal to a satellite communication transmitting frequency, amplifying the converted signal and providing the amplified signal to the communication band transceiving radiating unit; and a communication band receiving active unit for receiving a signal from the communication band transceiving radiating unit, performing a downlink frequency conversion on the received signal and outputting the converted signal.

20. The multi-band hybrid antenna system as recited in claim 19, wherein the transceiving active unit is connected to the first triplexer to receive a transmitting signal power outputted from the triplexer to the communication band transmitting active unit, and to output a receiving signal power from the communication band receiving active unit and the broadcasting band receiving active unit to the first triplexer.

21. The multi-band hybrid antenna system as recited in claim 19, wherein the broadcasting band receiving active unit has an active antenna structure attached at a rear surface of each of sofa shape sub arrays of the broadcasting band receiving radiating unit.

22. The multi-band hybrid antenna system as recited in claim 21, wherein the communication band transmitting active unit includes:

an uplink frequency converting means for uplink frequency converting an input signal and performing a gain control function to vary an intensity of a signal power;

a transmitting power dividing means for receiving a signal power outputted from the uplink frequency converting means through a single terminal and equally dividing the received signal power to a plurality of output terminals; and a transmitting active module having a plurality of multiple transmitting active blocks for equally dividing a signal power inputted from a single terminal to a plurality of output terminals.

23. The multi-band hybrid antenna system as recited in claim 22, wherein the transmitting active module performs a gain control function of a signal power, an amplifying function of the signal power and a phase control function.

24. The multi-band hybrid antenna system as recited in claim 23, wherein the transmitting active module performs a function of shaping and controlling a transmitting beam of the antenna system through a 1 st level phase control functions in each off a plurality of transmitting channels.

25. The multi-band hybrid antenna system as recited in claim 19, wherein the communication band receiving active unit includes:

a receiving active module having a plurality of multiple receiving active blocks for combining power of signal power inputted through a plurality of terminals and outputting the combined power;

a receiving beam shaping means having a plurality of channels through a plurality of input terminals each connected to an output terminal of the multiple receiving active blocks and performing a function of shaping and controlling a tracking beam for tracking a satellite through a phase control function of 2nd phase shifters in each channel;

a downlink frequency converting means for receiving a signal from the receiving beam shaping means, downlink frequency converting the received signal and outputting the converted signal; and a tracking signal detecting means for detecting a signal power inputted from the downlink frequency converting means as a voltage level and outputting the detected voltage level to the power source/controlling unit.

26. The multi-band hybrid antenna system as recited in claim 25, wherein the multiple receiving active block performs functions of controlling a gain of a signal power, low-noise amplifying a signal power and controlling a phase.

27. The multi-band hybrid antenna system as recited in claim 25, wherein the downlink frequency converting means includes two downlink frequency converters performing a same function, one of two downlink frequency converters outputs the output signal to the first triplexer for signal modulation, and other downlink frequency converter outputs an output signal to the tracking signal detecting means for tracking a satellite.

28. The multi-band hybrid antenna system as recited in claim 25, wherein the receiving beam shaping means sequentially forms four tracking beams offset around a main beam using the 2nd level phase shifters and uses the four tracking beams for tracking a satellite.

29. The multi-band hybrid antenna system as recited in claim 16, wherein the power source/controlling unit includes:

a power source for receiving an AC power from the stabilizing means, dividing the received AC power, converting the divided AC power to DC power, and outputting the DC power; and a controlling unit for providing control data to control the stabilizing means, detecting a voltage from the transceiving active unit and providing power and phase data to the transceiving active unit.

30. The multi-band hybrid antenna system as recited in claim 29, wherein the controlling unit includes:

a satellite tracking controlling means for transferring an antenna state to the stationary system, receiving a command from a user, providing a posture control command and receiving state information of the stabilizing driving means; and a posture controlling means for receiving a posture control command from the satellite tracking controlling means, receiving posture information from the stabilizing driving means and controlling a posture of the stabilizing driving means to face a target satellite although the stationary system is moved.

31. The multi-band hybrid antenna system as recited in claim 29, wherein the power source includes:

an AC power dividing means for receiving an external AC power and distributing the received power to a plurality of AC power terminals; and an AC-to-DC converter for receiving a portion of divided AC power and converting the received AC power to DC power.

32. The multi-band hybrid antenna system as recited in claim 15, wherein the communication transmitting band is a Ka band, the communication receiving band is a K band and the broadcasting receiving band is a Ku band.

33. The multi-band hybrid antenna system as recited in claim 15, wherein the first triplexer performs an antenna transmitting signal ON/OFF function using a switch.

34. The multi-band hybrid antenna system as recited in claim 11, wherein the second triplexer has a similar structure, compared to the first triplexer and is configured of three channels for inputting and outputting three band signals through an common terminal.

35. A multi-band hybrid antenna for providing a communication service and a satellite broadcasting receiving service, the multi-band hybrid antenna comprising:

a communication band transceiving antenna having an offset dual reflector structure including a main reflector and a sub reflector to transmit and to receive a communication band signal;

a broadcasting receiving antenna disposed above the sub reflector in parallel for directly receiving a broadcasting band signal.

36. The multi-band hybrid antenna system as recited in claim 35, wherein the broadcasting band receiving antenna is a flat array antenna structure and has a plurality of sub array antennas each having a soft structure which are arranged in a wave direction.

37. The multi-band hybrid antenna system as recited in claim 35, wherein the main reflector is disposed at a supporting member in parallel, and the sub reflector is disposed to be separated from the main reflector through a free space as an intermedium.

38. The multi-band hybrid antenna system as recited in claim 37, wherein the communication band transceiving antenna further includes an active feed array unit for inputting and outputting an incident and radiated electric wave after doubly reflecting on the main reflector and the sub reflector.

39. The multi-band hybrid antenna system as recited in claim 38, wherein the main reflector is mechanically moved by cooperating with the supporting member, and the sub reflector is mechanically moved with the main reflector and is independently moved.

40. The multi-band hybrid antenna system as recited in claim 39, wherein apertures of the main reflector and the sub reflector have a form of a curvilinear rim.

41. The multi-band hybrid antenna system as recited in claim 38, wherein the main reflector, the sub reflector and the active feed array unit are arranged with a limited circle when they are observed from a top elevation position.

42. The multi-band hybrid antenna system as recited in claim 41, wherein edges of the sub reflector and the active feed array unit have a modified oval shape and a surface of the sub reflector is a flat plate shape.

43. The multi-band hybrid antenna system as recited in claim 40, wherein edges of the sub reflector and the active feed array unit have a circular shape and the sub reflector has a shaped surface.

44. The multi-band hybrid antenna as recited in claim 35, wherein the communication band transceiving antenna further includes an active feed array unit and the multi-band hybrid antenna further comprises a stabilizing means for driving and controlling the communication band transceiving antenna in a mechanical fashion using the sub reflector and an electrical fashion using the active feed array unit.

45. A method of tracking a satellite in a dual reflector structure hybrid antenna system using a mechanical driving device and an electron beam tracking scheme for coarsely tracking a target satellite in a mechanical fashion and finely tracking a target satellite in an electrical fashion, the method comprising the steps of:

obtaining azimuth angle and wave angle information of a target satellite that provides a satellite communication and a satellite broadcasting at the hybrid antenna system;

controlling a posture of the hybrid antenna system to constantly face an antenna beam to the target satellite using the mechanical driving device although a moving object mounting the hybrid antenna system is moved;

acquiring a satellite signal by performing two-dimension mechanical scanning in a zig-zag manner at a sub reflector in the hybrid antenna system; and detecting a comparative position variation of the target satellite using an active phase array and continuously tracking the target satellite through performing a mechanical beam steering using the sub reflector and electron beam steering using an active phase array based on the detected position variation for continuously tracking the acquired satellite signal corresponding to movement of the moving object mounting the hybrid antenna system.

* * * * *